US007536880B2

(12) United States Patent
Gnadinger et al.

(10) Patent No.: US 7,536,880 B2
(45) Date of Patent: May 26, 2009

(54) MAGNETIC LID SWITCH

(75) Inventors: Errin Whitney Gnadinger, Louisville, KY (US); Kristian Michael Magnuson, Louisville, KY (US); Thomas William McConihay, Louisville, KY (US); John Jacob Lapina, Jr., Louisville, KY (US); Derek Lee Watkins, Elizabethtown, KY (US)

(73) Assignee: General Electric Company, Schenectady, NY (US)

( * ) Notice: Subject to any disclaimer, the term of this patent is extended or adjusted under 35 U.S.C. 154(b) by 875 days.

(21) Appl. No.: 10/847,940

(22) Filed: May 18, 2004

(65) Prior Publication Data

US 2005/0257578 A1 Nov. 24, 2005

(51) Int. Cl.
*D06F 33/02* (2006.01)

(52) U.S. Cl. ..... 68/12.02; 68/12.26; 68/196; 134/57 DL; 134/58 DL; 70/271; 70/276; 70/278.1; 292/341.14; 200/17 R; 200/43.07; 200/61.62; 200/61.7; 200/67.71; 200/61.73; 200/181; 200/329; 200/406; 335/205; 335/206; 335/207

(58) Field of Classification Search ..... 68/12.02, 68/12.26, 196; 134/57 DL, 58 DL; 70/271, 70/276, 278.1; 292/341.14; 200/17 R, 43.07, 200/61.62, 61.7, 61.71, 61.73, 181, 329, 200/406; 335/205, 206, 207
See application file for complete search history.

(56) References Cited

U.S. PATENT DOCUMENTS

| | | | | | |
|---|---|---|---|---|---|
| 3,397,372 | A | * | 8/1968 | Maxwell | 335/205 |
| 3,675,340 | A | * | 7/1972 | Davis | 434/340 |
| 3,699,300 | A | * | 10/1972 | Buerki | 219/722 |
| 3,852,692 | A | * | 12/1974 | Moorman | 335/205 |
| 4,150,350 | A | * | 4/1979 | Fong | 335/205 |
| 5,600,976 | A | | 2/1997 | Hapke et al. | |
| 5,668,533 | A | * | 9/1997 | Jackson et al. | 340/547 |
| 5,691,520 | A | | 11/1997 | Hapke et al. | |
| 5,728,985 | A | | 3/1998 | Hapke et al. | |
| 6,118,090 | A | | 9/2000 | Osvatic et al. | |

* cited by examiner

*Primary Examiner*—Frankie L Stinson
*Assistant Examiner*—Samuel A Waldbaum
(74) *Attorney, Agent, or Firm*—George L. Rideout, Esq.; Armstrong Teasdale LLP

(57) ABSTRACT

A magnetic lid switch assembly includes a first magnetically actuated electrical switch that has a lever arm movable between a first position wherein the first switch is open and a second position wherein the first switch is closed. A second magnetically actuated electrical switch electrically is connected in series with the first switch. The second switch has a lever arm movable between a first position wherein the second switch is open and a second position wherein the second switch is closed. A first actuator is magnetically coupled to the first switch. The first actuator moves the lever arm of the first switch closing the first switch to enable the first switch to pass an electric current when the first actuator is positioned proximate the first switch. A second actuator is magnetically coupled to the second switch. The second actuator moves the lever arm of the second switch closing the second switch to enable the second switch to pass an electric current when the second actuator is positioned proximate the second switch.

26 Claims, 9 Drawing Sheets

MAGNETIC LID SWITCH

BACKGROUND OF THE INVENTION

This invention relates generally to washing machines, and more particularly, to a lid safety switch for a washing machine.

Washing machines typically include a cabinet that houses an outer tub for containing wash and rinse water, a perforated clothes basket within the tub, and an agitator within the basket. A drive and motor assembly is mounted underneath the stationary outer tub to rotate the basket and the agitator relative to one another. The washing machine performs a number of cycles to complete a wash operation including a wash cycle and one or more rinse and spin cycles. See, for example, U.S. Pat. No. 6,029,298.

As is well known, a typical top-loading washing machine has a lid with a safety switch coupled thereto that is connected in series with the motor to prevent the motor from being energized when the lid is open. The lid switch provides an interlock safety feature wherein access to the clothes basket is prevented during the agitation cycle, and more importantly, during the spin cycle of the wash operation to prevent injury to the user.

In at least some known washing machines, the lid switch is mounted to a bracket that is positioned underneath the top cover of the cabinet. The lid switch has an operating lever that biases the switch in an open position wherein the switch does not pass an electrical current so that the motor is de-energized, or rendered inoperable. The operating lever is positioned proximate an hole in the cover that provides access to the operating lever. The lid has a prong that extends downwardly and is aligned with the access hole. When the lid is in an open position, or when the lid has been moved a predetermined distance from a closed position, the prong does not engage the operating lever so that the lid switch remains in the open position and does not allow the motor to be energized. When the lid is in the closed position, the prong extends into the access hole and engages the operating lever to place the lid switch in a closed position wherein the switch passes an electrical current, thereby allowing energization, and thus, operation of the motor.

Though effective, the design also has shortcomings. For instance, the lid switch can rather easily be overridden by the insertion of small objects such as a screwdriver blade, or a finger of a child. These events can result in unsafe operation of the washer by allowing the drum to spin or the agitator to oscillate while the lid is open.

BRIEF DESCRIPTION OF THE INVENTION

In one aspect, a magnetic lid switch assembly is provided. The assembly includes a first magnetically actuated electrical switch that has a lever arm movable between a first position wherein the first switch is open and a second position wherein the first switch is closed. A second magnetically actuated electrical switch electrically is connected in series with the first switch. The second switch has a lever arm movable between a first position wherein the second switch is open and a second position wherein the second switch is closed. A first actuator is magnetically coupled to the first switch. The first actuator moves the lever arm of the first switch closing the first switch to enable the first switch to pass an electric current when the first actuator is positioned proximate the first switch. A second actuator is magnetically coupled to the second switch. The second actuator moves the lever arm of the second switch closing the second switch to enable the second switch to pass an electric current when the second actuator is positioned proximate the second switch.

In another aspect, a magnetic lid switch assembly is provided that includes a switch housing including a pair of adjacent micro-switch chambers and first and second magnetically actuated micro-switches electrically connected in series with one another. Each micro-switch is received in a respective one of the micro-switch chambers and each micro-switch is operable between an open state wherein current flow through the switch is disabled and a closed state wherein current flow through the switch is enabled. The assembly also includes an actuator that includes an actuator housing including a pair of adjacent magnet wells and first and second actuator magnets. Each actuator magnet is received in a respective one of the magnet wells. The first actuator magnet is oriented to hold the first micro-switch in the closed state and the second actuator magnet is oriented to hold the second micro-switch in the closed state when the actuator is proximate the switch housing. The first actuator magnet is ineffective to hold the second micro-switch in the closed state and the second actuator magnet is ineffective to hold the first micro-switch in the closed state.

In another aspect, a washing machine is provided. The washing machine includes a top cover and a lid rotatably mounted to the top cover. The lid is movable between an open position and a closed position. A first magnetically actuated electrical switch and a second magnetically actuated electrical switch are electrically connected in series. The first and second switches are mounted on one of the lid and the top cover. A first actuator is magnetically coupled to the first switch to enable the first switch to pass an electric current when the lid is in the closed position. A second actuator is magnetically coupled to the second switch to enable the second switch to pass an electric current when the lid is in the closed position. The first and second actuators are mounted on the other of the lid and the top cover.

DETAILED DESCRIPTION OF THE INVENTION

Figure 1:
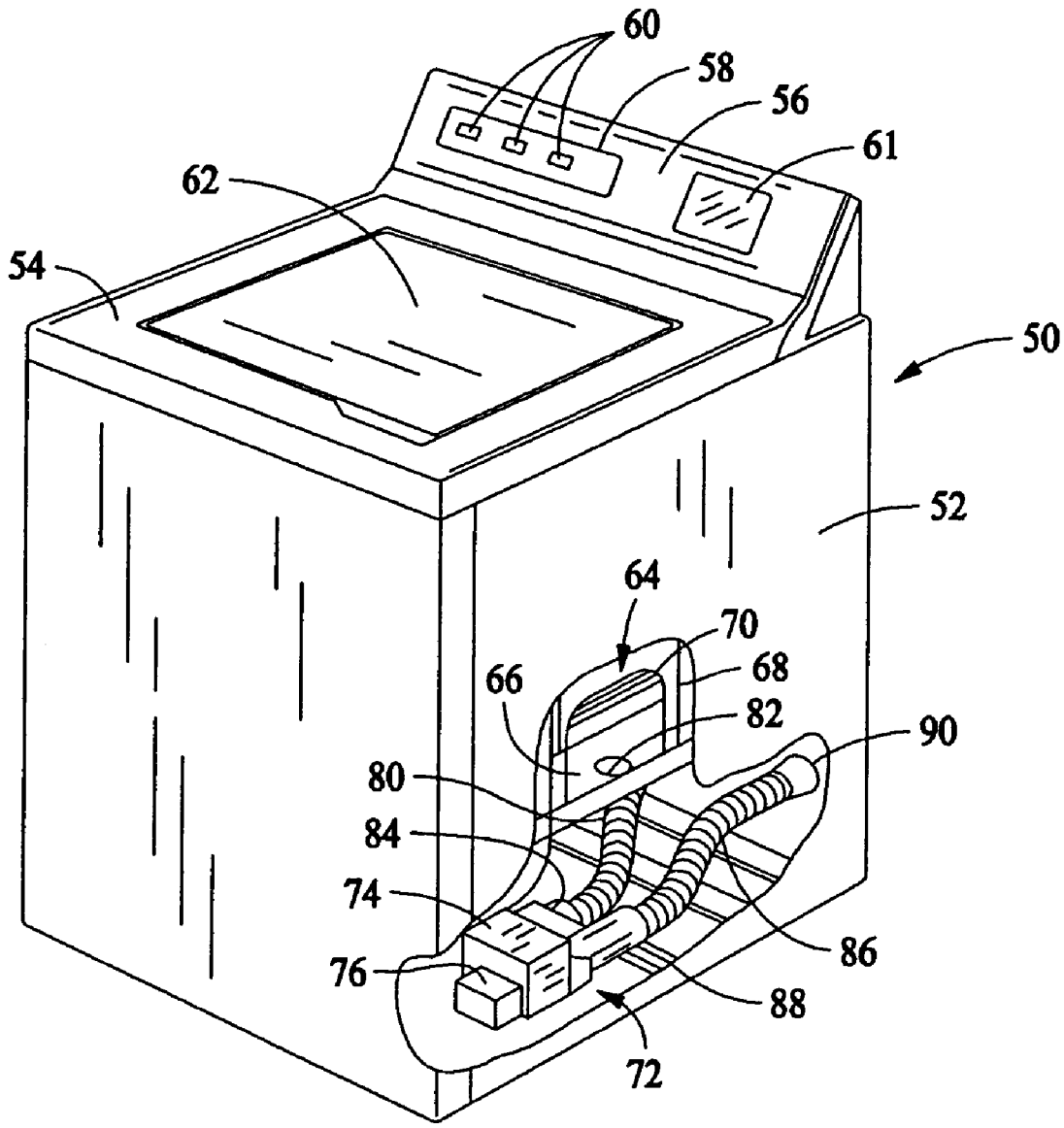
FIG. 1 is a perspective cutaway view of an exemplary washing machine.

FIG. 1 is a perspective view partially broken away of an exemplary washing machine 50 including a cabinet 52 and a top cover 54. A backsplash 56 extends from top cover 54, and a control panel 58 including a plurality of input selectors 60 is coupled to backsplash 56. Control panel 58 and input selectors 60 collectively form a user interface input for operator selection of machine cycles and features, and, in one embodiment, a display 61 indicates selected features, a countdown timer, and other items of interest to users. A lid 62 is mounted to top cover 54 and is rotatable about a hinge (not shown) between an open position (not shown) facilitating access to a wash tub 64 located within cabinet 52, and a closed position (shown in FIG. 1) forming a substantially sealed enclosure over wash tub 64. As illustrated in FIG. 1, machine 50 is a vertical axis washing machine. It is contemplated that the benefits of the invention accrue to other types of washing machines, including, but not limited to, horizontal axis machines.

Tub 64 includes a bottom wall 66 and a sidewall 68, and a basket 70 is rotatably mounted within wash tub 64. A pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

Figure 2:
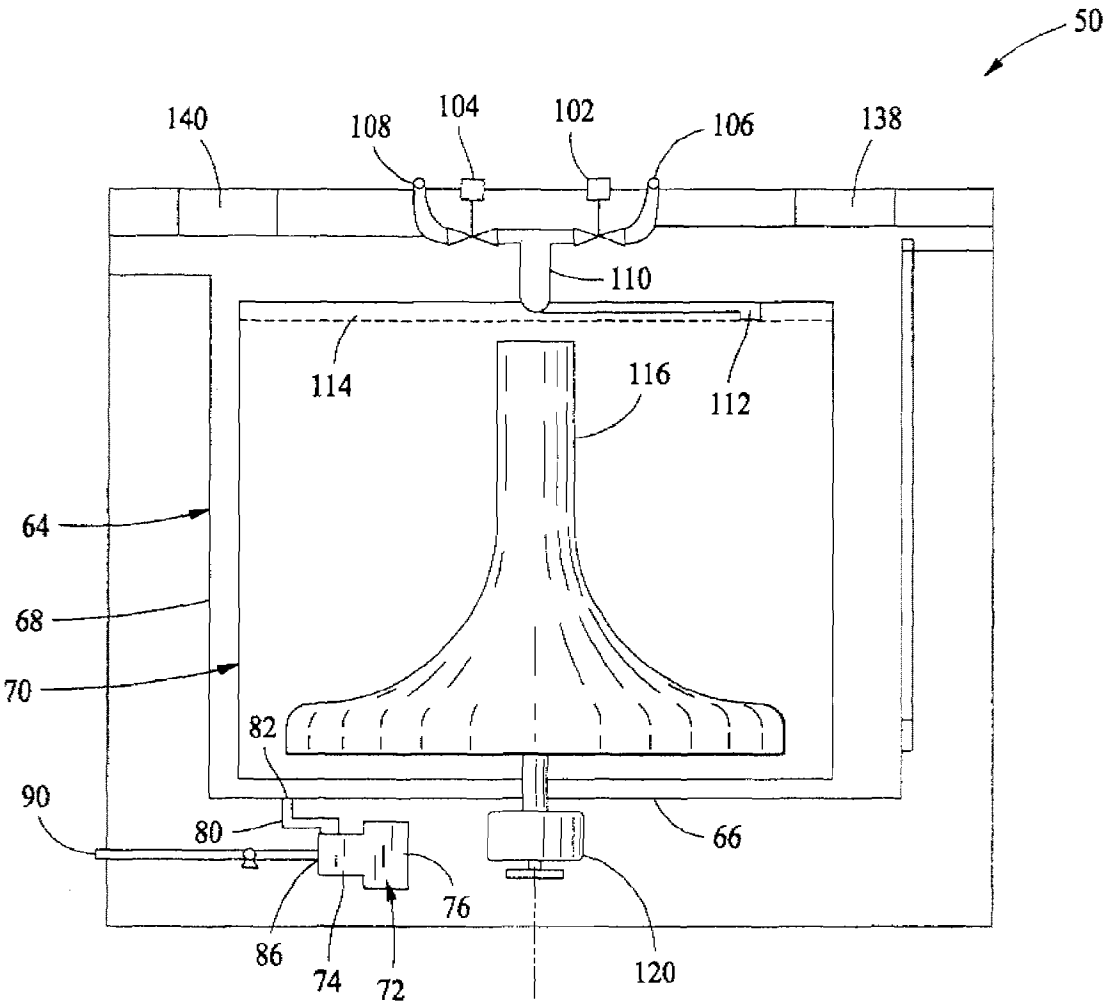
FIG. 2 is front elevational schematic view of the washing machine shown in FIG. 1.

FIG. 2 is a front elevational schematic view of washing machine 50 including wash basket 70 rotatably mounted in wash tub 64 in a spaced apart relationship from tub side wall 64 and tub bottom 66. Basket 70 includes a plurality of perforations therein to facilitate fluid communication between an interior of basket 70 and wash tub 64.

A hot water valve 102 and a cold water valve 104 deliver fluid to basket 70 and wash tub 64 through a respective hot liquid hose 106 and a cold liquid hose 108. Liquid valves 102, 104 and liquid hoses 106, 108 together form a liquid supply connection for washing machine 50 and, when connected to a building plumbing system (not shown), provide a water supply for use in washing machine 50. Liquid valves 102, 104 and liquid hoses 106, 108 are connected to a basket inlet tube 110, and fluid is dispersed from inlet tube 110 through a known nozzle assembly 112 having a number of openings therein to direct washing liquid into basket 70 at a given trajectory and velocity.

In an alternative embodiment, a known spray fill conduit 114 (shown in phantom in FIG. 2) may be employed in lieu of nozzle assembly 112. Along the length of the spray fill conduit 114 are a plurality of openings arranged in a predetermined pattern to direct incoming streams of water in a downward tangential manner towards articles in basket 70. The openings in spray fill conduit 114 are located a predetermined distance apart from one another to produce an overlapping coverage of liquid streams into basket 70. Articles in basket 70 may therefore be uniformly wetted even when basket 70 is maintained in a stationary position.

A known agitation element 116, such as a vane agitator, impeller, auger, or oscillatory basket mechanism, or some combination thereof is disposed in basket 70 to impart an oscillatory motion to articles and liquid in basket 70. Typically, a wash cycle is followed by one or more rinse and spin cycles. During the spin cycle, the basket 70 is rotated at a sufficiently high speed to centrifugally remove most of the water from the articles being washed. Basket 70 and agitator 116 are driven by motor 120. Washing machine 50 also includes a brake assembly (not shown) selectively applied or released for respectively maintaining basket 70 in a stationary position within tub 64 or for allowing basket 70 to spin within tub 64.

Operation of machine 50 is controlled by a controller 138 which is operatively coupled to the user interface input located on washing machine backsplash 56 (shown in FIG. 1) for user manipulation to select washing machine cycles and features. In response to user manipulation of the user interface input, controller 138 operates the various components of machine 50 to execute selected machine cycles and features.

During the agitate and spin cycles, it is desirable that the washer lid 62 remain closed so that the user does not have access to the washer interior. A lid switch assembly 140 is provided to control the flow of electrical current to motor 120 during the agitate and spin cycles of the wash operation. Lid switch assembly 140 interrupts the flow of electric current to motor 120 if lid 62 is raised or opened more than a predetermined amount. In an exemplary embodiment, lid switch assembly 140 interrupts current flow to motor 120 when lid 62 is raised two or more inches.

Figure 3:
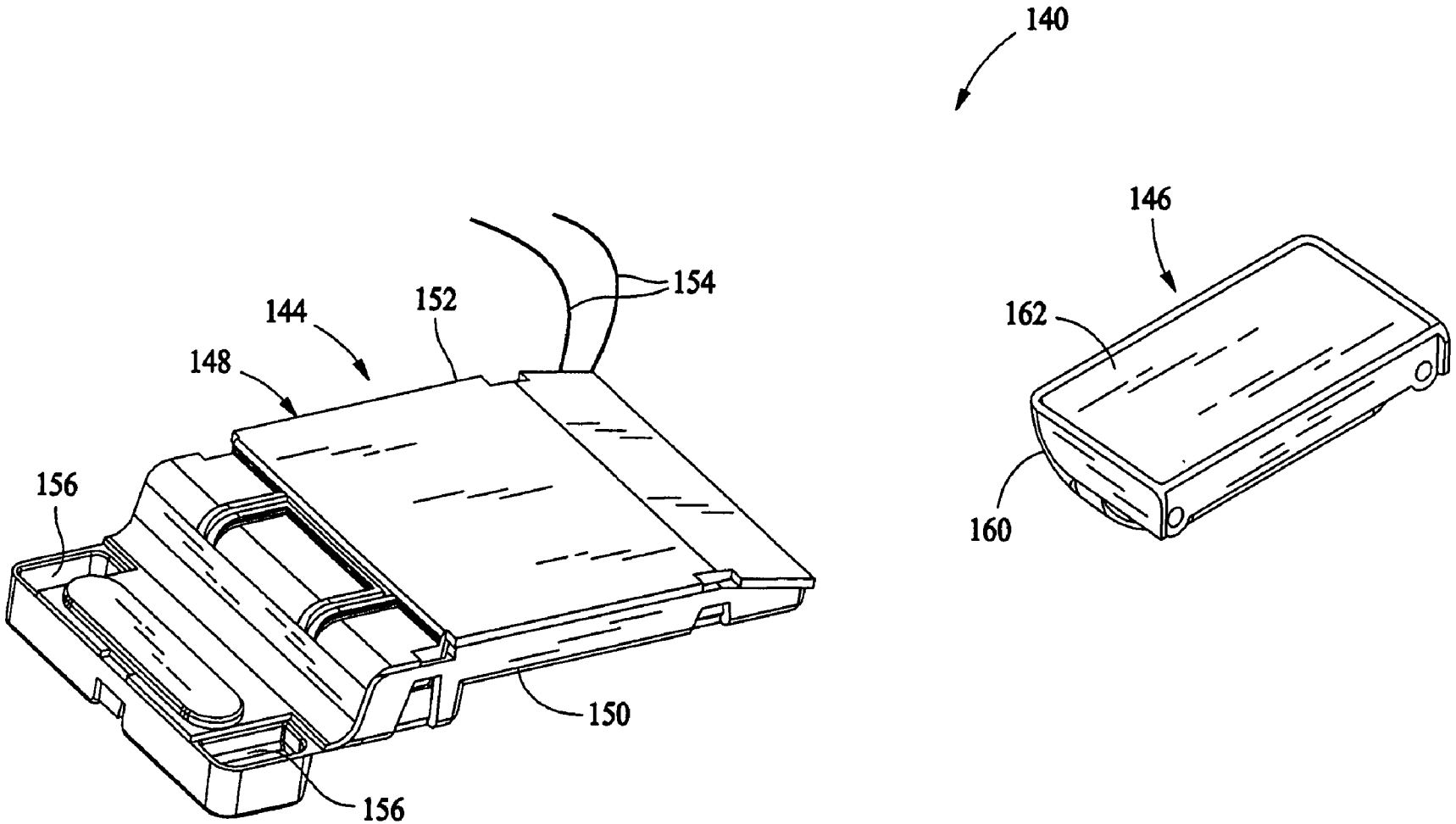
FIG. 3 is a perspective view of an exemplary lid switch assembly.

FIG. 3 is a perspective view of a switch unit 144 and an actuator 146 that together make up lid switch assembly 140. Switch unit 144 includes a housing 148 that has a body 150 and a cover 152. Housing body 150 includes a pair of attachment slots 156. Electrical wires 154 connect switch unit 144 and motor 120 (FIG. 2). Actuator 146 includes a housing 160 and a cover or flux plate 162 that is recessed into housing 160. In use, switch unit 144 is coupled to an underside of top cover 54 and actuator 146 is coupled to lid 62 as will be described hereinafter. In an alternative embodiment, actuator 146 is coupled to the underside of top cover 54 and switch unit 144 is coupled to lid 62.

Figure 4:
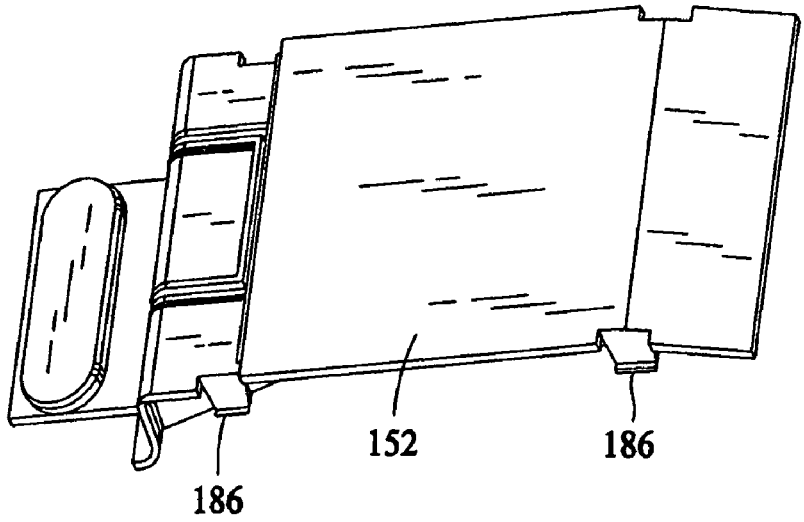
FIG. 4 is a perspective view showing the interior of the switch unit shown in Figure.
Figure 4:
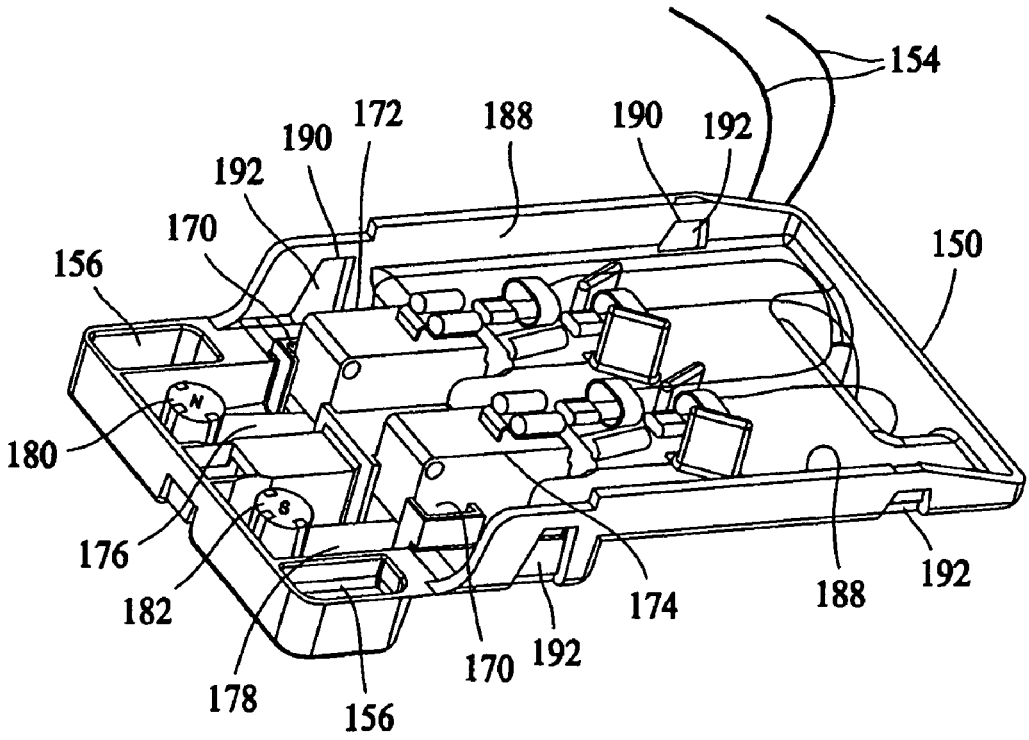

FIG. 4 is a perspective view of switch unit 144 with cover 152 removed from housing body 150. Switch unit 144 includes a pair of adjacent micro-switch chambers 170. A first micro-switch 172 and a second micro-switch 174 are each received in one of the chambers 170. Micro-switches 172 and 174 are electrically connected in series with one another. Each micro-switch 172, 174 includes a lever arm 176 and 178 respectively, that is movable in a plane between a first position, wherein micro-switches 172 and 174 are open, and a second position wherein micro-switches 172 and 174 are closed. When open, micro-switches 172 and 174 do not pass an electrical current such that motor 120 is de-energized. When closed, micro-switches 172 and 174 allow the passage of an electrical current such that motor 120 can be energized. Since micro-switches 172 and 174 are connected in series, both micro-switches 172 and 174 must be closed in order for motor 120 to be energized. Micro-switches 172 and 174 are sufficiently robust to carry and switch the high amperage motor current of a washing machine motor such as motor 120. Each lever arm 176, 178 includes a magnet 180, and 182, respectively, mounted thereon to facilitate magnetic actuation of the micro-switches 172 and 174. In the exemplary embodiment, magnets 180 and 182 are oriented opposite in polarity with respect to one another, that is, as shown in FIG. 4, magnet 180 has its north pole facing upward while magnet 182 has its south pole facing upward. In an alternative embodiment, magnets 180 and 182 are replaced by steel masses that are attracted by actuator 146.

Cover 152 is provided to inhibit the entry of moisture into switch unit 144. Cover 152 includes latch arms 186 that are indented inwardly and are received in the interior of housing body 150. Latch arms 186 slide along the inner side walls 188 of housing body 150 to engage edges 190 in openings 192 in side walls 188.

Figure 5:
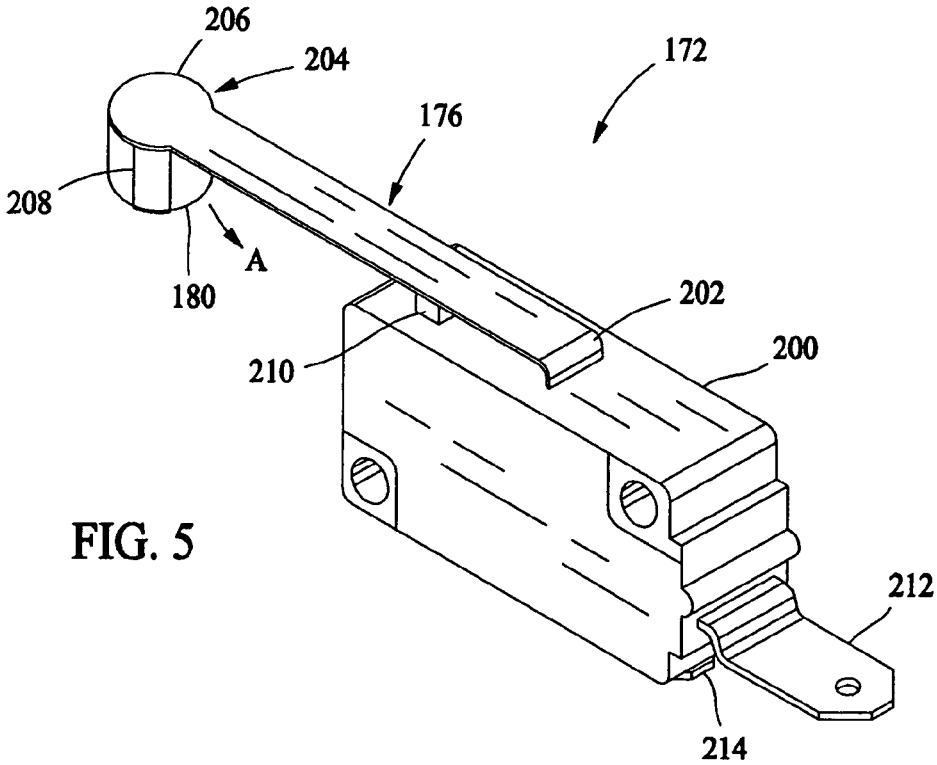
FIG. 5 is a perspective view of an exemplary micro-switch.

FIG. 5 illustrates a micro-switch such as micro-switch 172 in detail. Micro-switch 172 includes a body 200 and lever arm 176. Lever arm 176 has a proximal end 202 and a distal end 204. A magnet seat 206 is formed at distal end 204. Magnet 180 is positioned on seat 206 and is retained thereon by prongs 208. In the exemplary embodiment, magnet 180 is a permanent rare earth magnet fabricated from neodymium and is nickel plated. In an alternative embodiment, magnet 180 is replaced by a steel mass that is attracted by actuator 146. Also in the exemplary embodiment, there are three prongs 208 on lever arm 176 although only one is visible in FIG. 5. Proximal end 202 of lever arm 176 extends into the interior of switch body 200 wherein lever arm 176 is pivotally attached. Lever arm 176 depresses switch button 210 to close micro-switch 172 when lever arm 176 is pivoted in the direction of arrow A. In the exemplary embodiment, micro-switch 172 is a normally open micro-switch. Terminal tabs 212 and 214 (partially hidden) are provided for making electrical connections to micro-switch 172.

Figure 6:
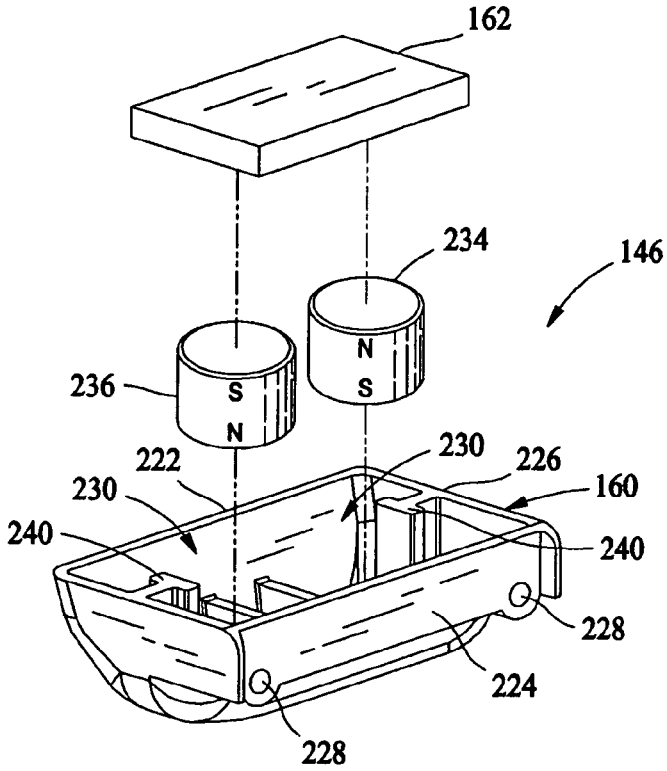
FIG. 6 is an exploded view of the actuator shown in FIG. 3.

FIG. 6 is an exploded view of actuator 146. Actuator housing 160 includes a first side 222, a second side 224, and opposed ends 226 separating sides 222 and 224. Side 224 includes mounting holes 228. Actuator housing 160 is substantially rectangular in shape; however, it is to be understood that other shapes are not intended to be excluded. A pair of magnet wells 230 are formed in the interior of actuator housing 160. A heat stake post 240 is provided at each end 226 of actuator housing 160.

A first actuator magnet 234 and a second actuator magnet 236 are each received in a respective one of magnet wells 230. First actuator magnet 234 and second actuator magnet 236 are oriented opposite in polarity with respect to each other. At the same time, each actuator magnet 234 and 236 is oriented to be in an attraction relation with a micro-switch magnet, such as magnet 180 and 182, respectively, (see FIG. 4) to which actuator magnet 2364 will be proximate when actuator 146 is juxtaposed switch unit 144. That is, first actuator magnet 234 and first switch magnet 180 form a magnet pair wherein the north pole of one of the magnet pair faces the south pole of the other of the magnet pair. Similarly, second actuator magnet 236 and second switch magnet 182 form a magnet pair wherein the north pole of one of the magnet pair faces the south pole of the other of the magnet pair. So arranged, first actuator magnet 234 does not attract second switch magnet 182 and is therefore ineffective to operate second micro-switch 174 (see FIG. 4). Likewise, second actuator magnet 236 does not attract first switch magnet 180 and is therefore ineffective to operate first micro-switch 172 (see FIG. 4). In the exemplary embodiment, actuator magnets 234 and 236 are also rare earth magnets fabricated from neodymium and are nickel plated.

Actuator 146 also includes cover or flux plate 162 that is sized to be received within actuator housing 160. Flux plate 162 is heat staked to heat stake posts 240 provided at each end 226 of actuator housing 160. In the exemplary embodiment, flux plate 162 is fabricated from a low carbon steel. Flux plate 162 in conjunction with actuator magnets 234 and 236 induces a magnetic flux toward switch unit 144 to increase a magnetic flux field with respect to switch magnets 180 and 182 in switch housing 148.

Figure 7:
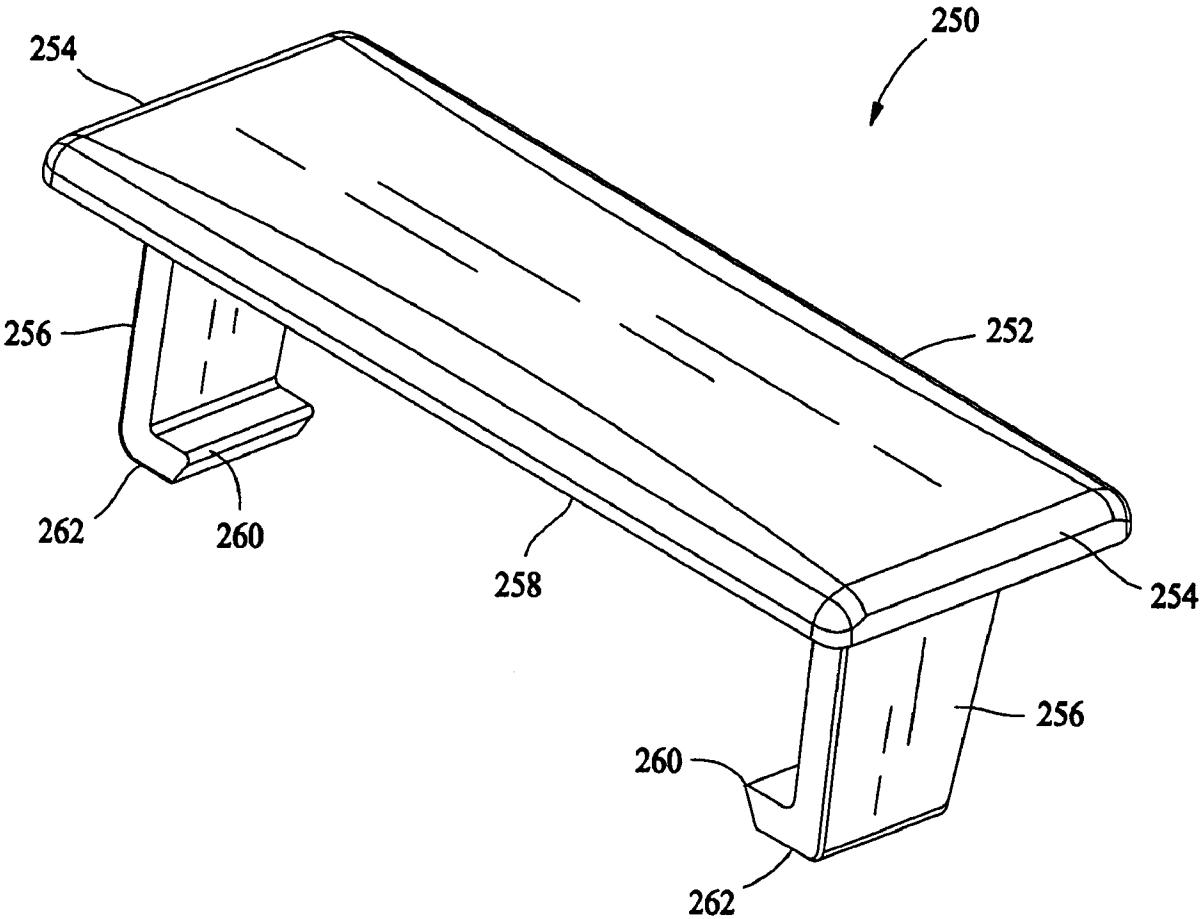
FIG. 7 is a perspective view of an exemplary snap clip.

FIG. 7 is a perspective view of a snap clip 250 that is used to attach switch unit 144 to washing machine top cover 54 (see FIG. 1). Snap clip 250 includes an elongated cap 252 having opposed ends 254. A clamping arm 256 proximate each end 254 extends downwardly from a underside 258 of cap 252. A latch element 260 is formed at an end 262 of each clamping arm 256. Clamping arms 256 are sized to be received in attachment slots 156 in switch housing body 150 (FIG. 3). In use, snap clip 250 is positioned on an upper side of top cover 54. Clamping arms 256 extend downwardly through an opening in top cover 54. Switch unit 144 is positioned below the opening so that clamping arms 256 are received in attachment slots 156. Each latch element 260 engages a ledge 272 (see FIG. 9) in attachment slot 156 with a snap fit to retain switch unit 144 on the underside of top cover 54.

Figure 8:
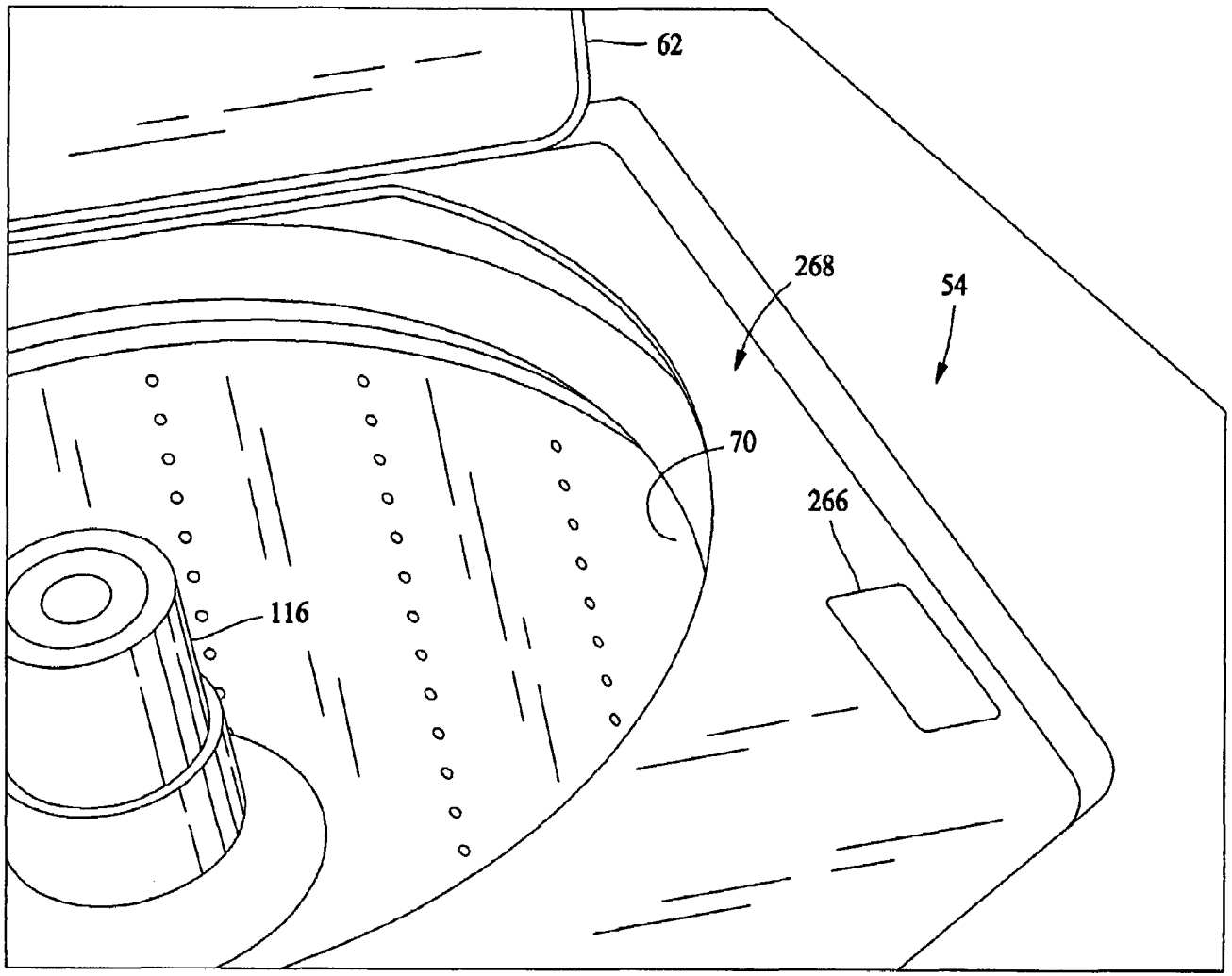
FIG. 8 is a partial perspective view of the upper side of a top cover showing a snap clip attachment hole.
Figure 9:
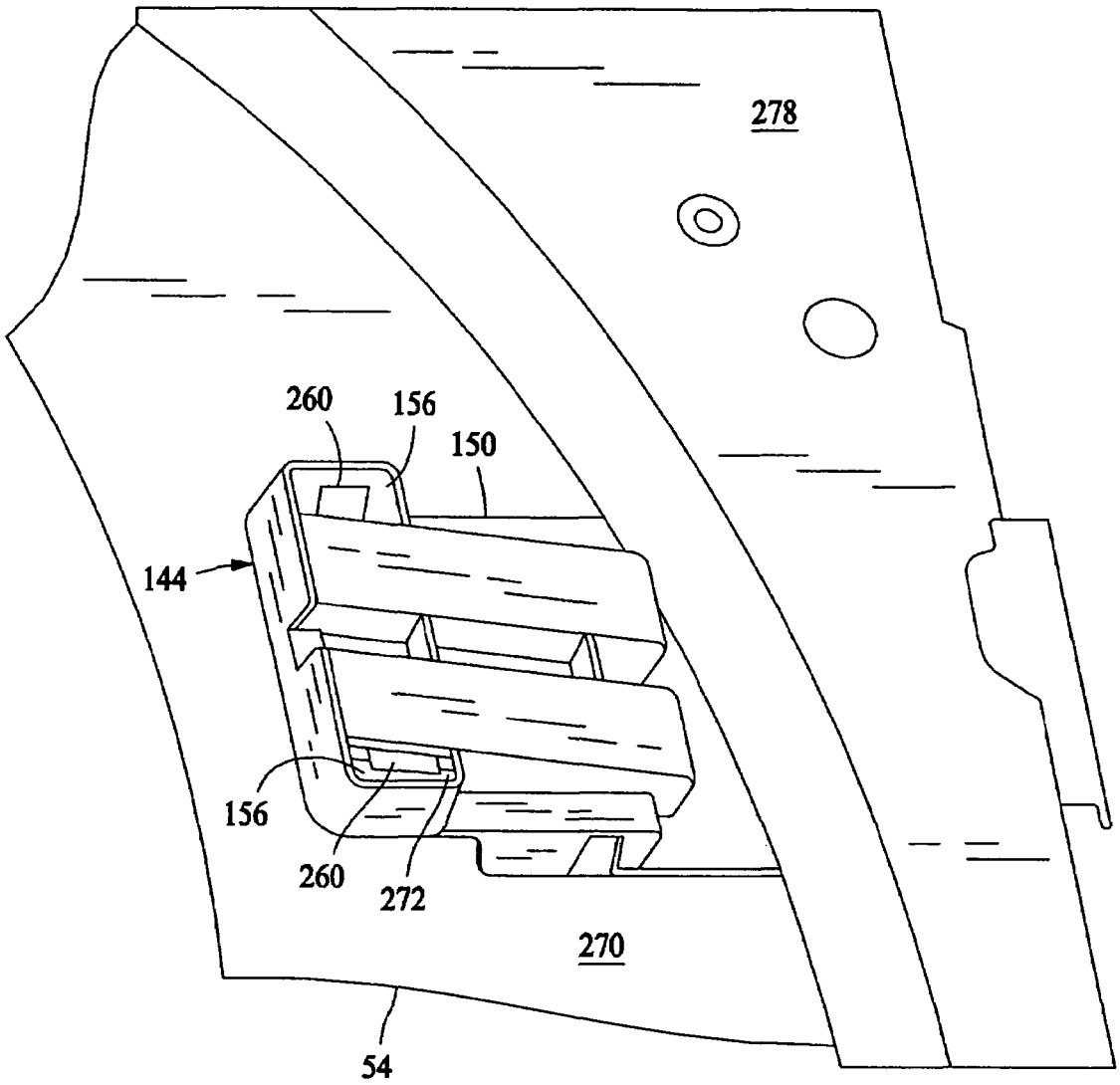
FIG. 9 is a partial perspective view of the underside of a top cover showing the attachment of a switch housing to the top cover.

With reference to FIGS. 8 and 9, the attachment of switch unit 144 to top cover 54 will be described. FIG. 8 is a partial perspective view of an upper side of top cover 54. Top cover 54 includes an opening 266 positioned in a top cover recess 268 that corresponds to a mounting location for switch unit 144. Opening 266 is rectangular in shape, corresponding to a shape of cap 252 of snap clip 250. Opening 266 is sized so that cap 252 is larger than opening 266 while clamping arms 256 are received through opening 266 to extend below an underside of top cover 54. When clamping arms 256 are fully inserted in opening 266, opening 266 is completely covered by cap 252 on while cap 252 showing a snap clip attachment hole.

FIG. 9 is a partial perspective view of the underside of top cover 54 illustrating the attachment of switch unit 144 to top cover 54. In FIG. 9, switch unit 144 is shown positioned against a lower surface 270 of top cover 54 between top cover 54 and a frame member 278. Switch unit 144 is positioned such that attachment slots 156 are open and aligned with opening 266 (FIG. 8) in top cover 54. Clamping arms 256 of snap clip 250 are inserted into opening 266 from an upper side of top cover 54 through opening 266 and inserted into attachment slots 156 in switch housing body 150. Latch elements 260 engage and snap over ledges 272 to retain switch unit 144 with a snap fit against lower surface 270 of top cover 54.

Figure 10:
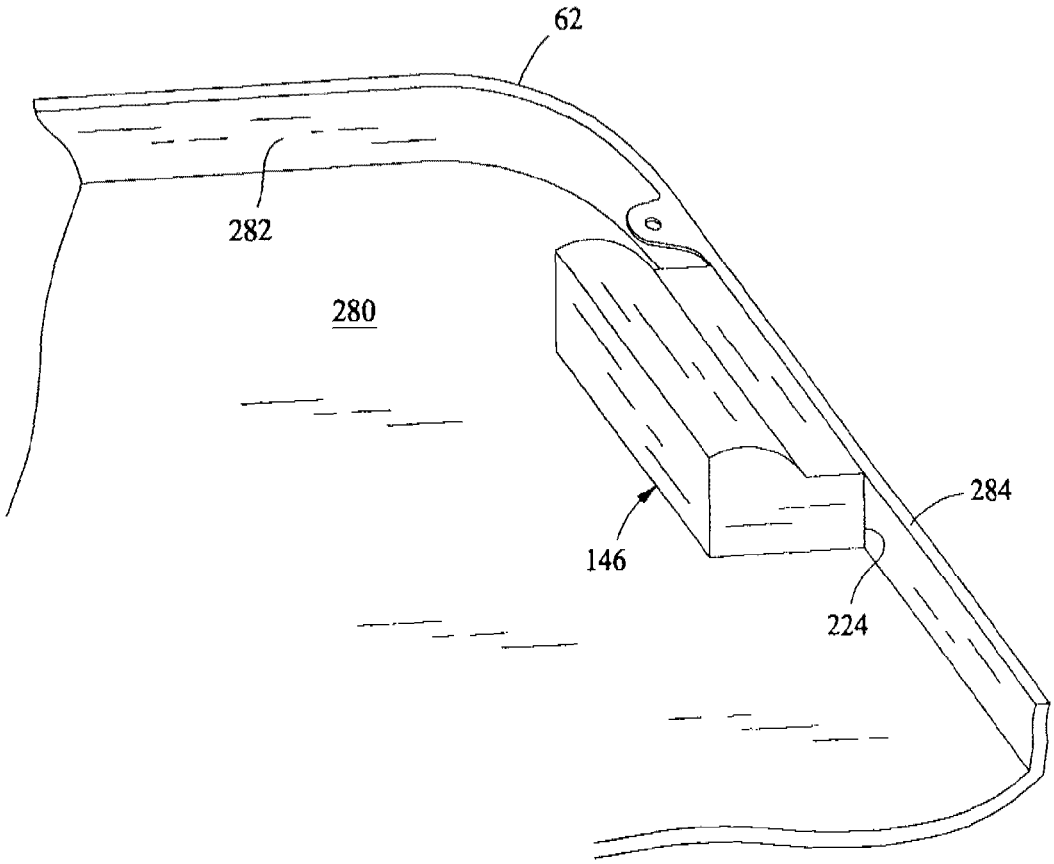
FIG. 10 is a partial perspective view of a lid showing the attachment of an actuator.

FIG. 10 is a partial perspective view illustrating the attachment of actuator 146 to an underside 280 of lid 62. Lid 62 includes a side edge 282 extending around a perimeter thereof. Side edge 282 includes an inwardly extending lip 284. Actuator 146 is positioned on lid 62 with flux plate 162 engaging underside 280 of lid 62. Side 224 of actuator housing 160 is positioned against side edge 282 and under lip 284 with mounting holes 228 (FIG. 6) aligned with corresponding holes (not shown) in side edge 282 and attached using suitable fasteners such as screws (not shown). Actuator 146 is positioned on lid 62 such that when lid 62 is in a closed position, actuator 146 is positioned over switch unit 144 and with actuator magnets 234 and 236 axially aligned with respective switch magnets 180 and 182. With actuator 146 so positioned and with magnets 180, 182, 234, and 236 aligned as described, micro-switches 172 and 174 are in a closed state to pass an electrical current when lid 62 is closed such that motor 120 is energized. When lid 62 is opened, micro-switches 172 and 174 revert to their normally open state wherein motor 120 is de-energized. In the exemplary embodiment, current flow to motor 120 is interrupted when lid 62 is opened two or more inches.

The above described apparatus provides a magnetic lid switch assembly that effectively interrupts current flow to a washing machine motor when the washing machine lid is raised. The design eliminates the conventional switch access hole which renders the switch assembly less susceptible to tampering or being overridden. An additional measure of both tamper resistance and safety is achieved by the polarity orientations of the magnets with respect to each other. The assembly uses a pair of micro-switches connected in series which provides an element of redundancy in the system.

While the invention has been described in terms of various specific embodiments, those skilled in the art will recognize that the invention can be practiced with modification within the spirit and scope of the claims.

What is claimed is:

1. A magnetic lid switch assembly comprising:

a first magnetically actuated electrical switch, said first switch having a first magnet and a lever arm movable between a first position wherein said first switch is open and a second position wherein said first switch is closed;

a second magnetically actuated electrical switch electrically connected in series with said first switch, said second switch having a second magnet oriented opposite in polarity with respect to said first magnet and a lever arm movable between a first position wherein said second switch is open and a second position wherein said second switch is closed;

a first actuator magnetically coupled to said first switch, said first actuator comprising a first actuator magnet oriented opposite in polarity with respect to said first magnet and arranged such that said first actuator magnet does not attract said second magnet, said first actuator moving said lever arm of said first switch closing said first switch to enable said first switch to pass an electric current when said first actuator magnetically actuates said first switch; and a second actuator magnetically coupled to said second switch, said second actuator comprising a second actuator magnet oriented opposite in polarity with respect to said second magnet and arranged such that said second actuator magnet does mot attract said first magnet, said second actuator moving said lever arm of said second switch closing said second switch to enable said second switch to pass an electric current when said second actuator magnetically actuates said second switch.

2. A magnetic lid switch assembly in accordance with claim 1 wherein said first and second switches are positioned adjacent one another.

3. A magnetic lid switch assembly in accordance with claim 1 wherein said first magnet coupled to said first lever arm, and said second magnet is coupled to said second lever arm.

4. A magnetic lid switch assembly in accordance with claim 3 wherein said first actuator is ineffective to close said second switch and said second actuator is ineffective to close said first switch.

5. A magnetic lid switch assembly in accordance with claim 3 wherein said first actuator magnet oriented to move said first magnet and said first lever arm to close said first switch when said first actuator is proximate said first switch, and said second actuator magnet oriented to move said second magnet and said second lever arm to close said second switch when said second actuator is proximate said second switch.

6. A magnetic lid switch assembly in accordance with claim 5 further comprising a flux plate in conjunction with said first actuator magnet and said second actuator magnet configured to induce a magnetic flux to increase a magnetic flux field with respect to said first magnet and said second magnet.

7. A magnetic lid switch assembly in accordance with claim 5 wherein said first and second magnets on said first and second lever arms respectively, and said first and second actuator magnets are permanent magnets.

8. A magnetic lid switch assembly in accordance with claim 1 wherein said first and second switches are normally open.

9. A magnetic lid switch assembly comprising:

a switch housing comprising a pair of adjacent micro-switch chambers;

a first magnetically actuated micro-switch and a second magnetically actuated micro-switch electrically connected in series with said first micro-switch, each of said first micro-switch and said second micro-switch received in a respective one of said pair of adjacent micro-switch chambers, said first micro-switch comprising a first magnet and said second micro-switch comprising a second magnet, said first magnet oriented opposite in polarity with respect to said second magnet, and each of said first micro-switch and said second micro-switch operable between an open state wherein current flow through said switch is disabled and a closed state wherein current flow through said switch is enabled; and an actuator comprising:

an actuator housing including a pair of adjacent magnet wells; and a first actuator magnet and a second actuator magnet, each of said first actuator magnet and said second actuator magnet received in a respective one of said pair of magnet wells, said first actuator magnet oriented opposite in polarity with respect to said first magnet and arranged such that said first actuator magnet does not attract said second magnet, and said second actuator magnet oriented opposite in polarity with respect to said second magnet and arranged such that said second actuator magnet does not attract said first magnet, said first actuator magnet oriented to hold said first micro-switch in said closed state and said second actuator magnet oriented to hold said second micro-switch in said closed state when said actuator is proximate said switch housing.

10. A magnetic lid switch assembly in accordance with claim 9 wherein said actuator housing further comprises a flux plate in conjunction with said first actuator magnet and said second actuator magnet configured to induce a magnetic flux to increase a magnetic flux field with respect to said first magnet and said second magnet.

11. A magnetic lid switch assembly in accordance with claim 9 wherein said switch housing is configured to be coupled to a washing machine top cover.

12. A magnetic lid switch assembly in accordance with claim 11 further comprising a snap clip member having clamping arms extending from an upper side of said top cover to hold said switch housing against an opposite lower side of said top cover in snap fit engagement.

13. A washing machine comprising:

a top cover;

a lid rotatably mounted to said top cover, said lid movable between an open position and a closed position;

a first magnetically actuated electrical switch comprising a first magnet;

a second magnetically actuated electrical switch electrically connected in series with said first switch and comprising a second magnet, said first magnet arranged opposite in polarity with respect to said second magnet, said first and second switches mounted on one of said lid and said top cover;

a first actuator magnetically coupled to said first switch, said first actuator comprising a first actuator magnet oriented opposite in polarity with respect to said first magnet and arranged such that said first actuator magnet does not attract said second magnet, said first actuator configured to enable said first switch to pass an electric current when said lid is in said closed position; and a second actuator magnetically coupled to said second switch, said second actuator comprising a second actuator magnet oriented opposite in polarity with respect to said second magnet and arranged such that said second actuator magnet does not attract said first magnet, said second actuator configured to enable said second switch to pass an electric current when said lid is in said closed position, said first and second actuators mounted on the other of said lid and said top cover.

14. A washing machine in accordance with claim 13 wherein each said first and second switches comprises a micro-switch, said first and second micro-switches positioned adjacent one another.

15. A washing machine in accordance with claim 14 wherein said first micro-switch comprises a lever arm and said first magnet is coupled to said lever arm.

16. A washing machine in accordance with claim 15 wherein said first actuator is ineffective to actuate said second switch and said second actuator is ineffective to actuate said first switch.

17. A washing machine in accordance with claim 14 wherein said first and second micro-switches are received in a common switch housing.

18. A washing machine in accordance with claim 17 wherein said switch housing is mounted to an underside of said top cover.

19. A washing machine in accordance with claim 17 further comprising a snap clip member having clamping arms extending from an upper side of said top cover to hold said switch housing against an opposite lower side of said top cover in snap fit engagement.

20. A washing machine in accordance with claim 13 wherein said first magnet is a permanent magnet.

21. A washing machine in accordance with claim 13 wherein said first and second switches are operable to control a motor current in said washing machine.

22. A washing machine in accordance with claim 13 wherein said first and second actuator magnets adjacent one another in a common actuator housing, and a flux plate in conjunction with said first and second actuator magnets configured to induce a magnetic flux to increase a magnetic flux field with respect to said first and second magnets.

23. A washing machine in accordance with claim 22 wherein said first and second actuator magnets are permanent magnets.

24. A washing machine in accordance with claim 22 wherein said actuator housing is mounted on said lid.

25. A washing machine in accordance with claim 13 wherein said first actuator comprises a first magnetic mass facing said first magnet of said first electrical switch to enable said first electrical switch to pass an electric current when said lid is in said closed position, and said second actuator comprises a second magnetic mass facing said second magnet of said second electric switch to enable said second electrical switch to pass an electric current when said lid is in said closed position.

26. A washing machine in accordance with claim 25 wherein said first magnetic mass and said second magnetic mass are arranged opposite in polarity with respect to one another

* * * * *